US006089388A

United States Patent [19]

Willim

[11] Patent Number: 6,089,388

[45] **Date of Patent: *Jul. 18, 2000**

[54] MOBILE CRANE

[75] Inventor: Hans-Dieter Willim, Ulm-Unterweiler, Germany

[73] Assignee: Liebherr-Werk Ehingen GmbH, Ehingen/Donau, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/915,576

[22] Filed: Aug. 21, 1997

[30] Foreign Application Priority Data

| | | | |
|---|---|---|---|
| Aug. 23, 1996 | [DE] | Germany | 196 34 158 |
| Jul. 15, 1997 | [DE] | Germany | 197 30 361 |

[51] Int. Cl.[7] ..... B66C 23/42

[52] U.S. Cl. ..... 212/298; 212/299; 212/178

[58] Field of Search ..... 212/175, 177, 212/178, 298, 299, 300

[56] References Cited

U.S. PATENT DOCUMENTS

| | | | |
|---|---|---|---|
| 2,774,484 | 12/1956 | White | 212/178 |
| 3,125,227 | 3/1964 | Kauffman et al. | 212/300 |
| 3,471,035 | 10/1969 | Randall | 212/298 |
| 3,517,829 | 6/1970 | Tax | 212/256 |
| 4,050,586 | 9/1977 | Morrow et al. | 212/298 |
| 4,081,081 | 3/1978 | Morrow et al. | 212/178 |
| 4,354,607 | 10/1982 | Hilgers | 212/175 |
| 4,579,234 | 4/1986 | Delago et al. | 212/178 |
| 4,867,321 | 9/1989 | Montgon | 212/196 |
| 5,005,714 | 4/1991 | Kröll et al. | 212/196 |
| 5,035,337 | 7/1991 | Juergens | 212/196 |
| 5,240,129 | 8/1993 | Schrick et al. | 212/298 |
| 5,484,069 | 1/1996 | Lanning | 212/175 |
| 5,586,667 | 12/1996 | Landry | 212/298 |

FOREIGN PATENT DOCUMENTS

| | | | |
|---|---|---|---|
| 0 779 235 | 6/1997 | European Pat. Off. . | |
| 1938154 | 3/1970 | Germany | 212/298 |
| 2428073 | 12/1975 | Germany | 212/231 |
| 3838975 | 5/1990 | Germany | 212/178 |
| 893829 | 12/1981 | U.S.S.R. | 212/299 |
| 1 466 686 | 3/1977 | United Kingdom . | |
| 2056944 | 3/1981 | United Kingdom | 212/300 |

*Primary Examiner*—Thomas J. Brahan

*Attorney, Agent, or Firm*—Jacobson, Price, Holman & Stern, PLLC

[57] ABSTRACT

A counter-jib on which ballast can be hung and a hydraulic ram which can swivel said counter-jib both being falcrumed on a supporting frame. The frame is bolted at at least two connecting points to the rotating deck in such a way that after the creation of the bolt connection located in the area of the fulcrum part, the other connecting point of the bolt connection can be swivelled at its bolting position on the rotating deck by luffing up the retracted jib. The mobile crane in accordance with the invention possesses as an additional piece of equipment a counter-jib whose installation allows said mobile crane to be converted into a derrick crane with a very much higher lifting capacity. To install the counter-jib, it is placed by an auxiliary crane onto the retracted telescope jib lowered onto the vehicle in such away that the supporting frame of the counter-jib can be bolted to the rotating deck at a connecting point located on the rotating deck in the area of fulcrum of the fulcrum part of the telescoping jib. Subsequently, the counter-jib is lowered by the auxiliary crane fully onto the fulcrum part, the counter-jib being supported on the fulcrum part by means of a supporting shoe or supporting device which can slide on the fulcrum part or the counter-jib. Then the retracted sib is luffed up by its luffing ram until the second connecting point of the supporting frame has been swivelled into its bolting position on the rotating deck so that in this position the supporting frame can be fully connected to the rotating deck by means of bolting. After such bolting, the counter-jib can be swivelled backwards so that crane operation can begin once the holding rope or adjusting rope has been reeved and the ballast hung on.

10 Claims, 6 Drawing Sheets

MOBILE CRANE

BACKGROUND OF THE INVENTION

The invention relates to a mobile crane with a rotating deck supported on the vehicle chassis with a hoist mechanism on which rotating deck the fulcrum part of a telescoping jib which can be swivelled by hydraulic rams is supported.

The lifting capacity of such a mobile crane is limited by its stability and by the strength of its individual components. It is known to increase the lifting capacity to locate ballast on the side of the rotating deck opposite the telescoping jib.

SUMMARY OF THE INVENTION

The object of the invention is to substantially increase the lifting capacity of a mobile crane of the type first given.

In accordance with the invention, this object is solved by a counter-jib on which ballast can be hung and a hydraulic ram which can swivel said counter-jib both being falcrumed on a supporting frame. The frame is bolted at at least two connecting points to the rotating deck in such a way that after the creation of the bolt connection located in the area of the fulcrum part, the other connecting point of the bolt connection can be swivelled at its bolting position on the rotating deck by luffing up the retracted jib.

The mobile crane in accordance with the invention possesses as an additional piece of equipment a counter-jib whose installation allows said mobile crane to be converted into a derrick crane with a very much higher lifting capacity. To install the counter-jib, it is placed by an auxiliary crane onto the retracted telescope jib lowered onto the vehicle in such a way that the supporting frame of the counter-jib can be bolted to the rotating deck at a connecting point located on the rotating deck in the area of fulcrum of the fulcrum part of the telescoping jib. Subsequently, the counter-jib is lowered by the auxiliary crane fully onto the fulcrum part, the counter-jib being supported on the fulcrum part by means of a supporting shoe or supporting device which can slide on the fulcrum part or the counter-jib. Then the retracted jib is luffed up by its luffing ram until the second connecting point of the supporting frame has been swivelled into its bolting position on the rotating deck so that in this position the supporting frame can be fully connected to the rotating deck by means of bolting. After such bolting, the counter-jib can be swivelled backwards so that crane operation can begin once the holding rope or adjusting rope has been reeved and the ballast hung on.

Appropriately, an adjustment winch and a ballast winch are installed in the counter-jib. These winches can be provided with hydraulic motors so that they are ready for operation as soon as the supply lines have been connected to the hydraulic oil supply of the base crane.

Appropriately, the adjusting rope remains reeved in its retracted state over a block held at the tip of the counter-jib, the suspension clip of which block can be connected in the state of the counter-jib where it lies in a flat position on the retracted jib to the outer rim area of a telescoping section. When this connection has been made and after corresponding luffing up of the telescoping jib, the counter-jib can be lowered backwards with the luffing ram so that by a corresponding actuation of the adjustment winch, the adjusting rope can be reeled off it.

Furthermore, the ballast rope can also be reeved in the retracted state over a block held at the tip of the counter-jib so that this only needs to be extended to hang on the ballast.

Appropriately, the suspension clip of the block is connected to a rack holding the ballast plates which rack is lowered on the counter jib in the transport position. Here, the rack should possess a weight such that it pulls out the ballast rope when the ballast winch is actuated correspondingly.

In accordance with a preferred embodiment of the invention, it is provided that the telescoping jib and its luffing rams as well as the counter-jib and its luffing rams are designed in such a way that in crane operation the telescoping jib can be luffed by the adjusting rope. For this purpose, the luffing rams of the telescoping jib are set to the 'float' position. Here, the luffing rams of the telescoping jib can additionally take on the function of safety retainers which prevent an overturning of the telescoping jib in the event of wind force from the front or of a load breaking off.

In a further embodiment of the invention, it is provided that a hoist winch can be connected to the rear of the fulcrum part for luffing tip operation. For this purpose, the adjusting rope can be reeved between the derrick jib and the telescoping jib over two groups of pulleys located at the side in such a way that a centre free area is given through which the adjustment block for the luffing tip operation runs. The winch for the luffing tip operation can be bolted to the fulcrum part of the telescoping jib in such a way that this is seated equally on the neck of the fulcrum part.

As the telescoping jib with the mounted luffing tip is largely balanced by the counter-jib and the ballast, the luffing tip is capable of taking up high loads in any position of the telescoping jib.

The stability is substantially improved by the derrick jib and the floating ballast. The bending strain of the telescoping jib is substantially reduced due to the back stress to the derrick jib.

Despite the installed counter-jib, the telescoping crane in accordance with the invention possesses good manoeuvrability. By luffing up the counter jib, the ballast can be swivelled so closely to the axis of rotation of the rotating deck that approximately the same moment is exerted towards the back as would occur if the ballast were bolted directly to the rotating deck. With ballast correspondingly close-positioned to the axis of rotation of the rotating deck, the crane can be turned through 360° even without any load and in a steep jib position without needing to fear any backward turnover.

In steep jib positions where only a small load moment exists, the ballast can be swivelled very closely to the rotating deck so that the backward rotation radius of the ballast becomes very small.

The counter-jib provided in accordance with the invention is an additional piece of equipment of the base crane formed by the mobile crane which can be installed and also removed very simply and quickly without having to provide the base crane with any basic modifications. As the counter-jib and the ballast can be transported separately, the total weight of the mobile crane is not increased so that the total weight laid down by official road transportation regulations can easily be observed.

Due to the back stress on the telescoping jib from the counter-jib, a substantial reduction in the bending moment applied to the telescoping jib is achieved so that in particular for medium and high working radii, substantial increases in the workload can be achieved. With the derrick equipment in accordance with the invention, the telescoping jib is relieved by corresponding guying. In addition, due to the large backward ballast radius, relief also occurs for other components such as is known from conventional derrick devices in latticed derrick jib cranes.

The mobile crane in accordance with the invention creates the advantage for the crane operator that he can almost double the lifting capacity of the crane with a relatively low investment cost. The base crane can continue to be used as a conventional telescoping crane with this meeting official road transport regulations. The base crane can be transported in a conventional manner quickly and simply to its different sites. Only in the event of heavy load lifts, which occur relatively rarely, is the additional piece of equipment in accordance with the invention installed.

One special advantage arises from the fact that the additional piece of equipment in accordance with the invention leads to a substantial increase in the workload in luffing tip operation of the mobile crane.

BRIEF DESCRIPTION OF THE DRAWINGS

One embodiment of the invention is described in more detail below by means of the drawing. In which is shown FIG. 1 a side view of a mobile crane with retracted and lowered telescoping jib on which a counter-jib has been placed which is bolted to the rotating deck with one side of its supporting frame.

DETAILED DESCRIPTION OF THE PREFERRED EMBODIMENTS

Figure 1:
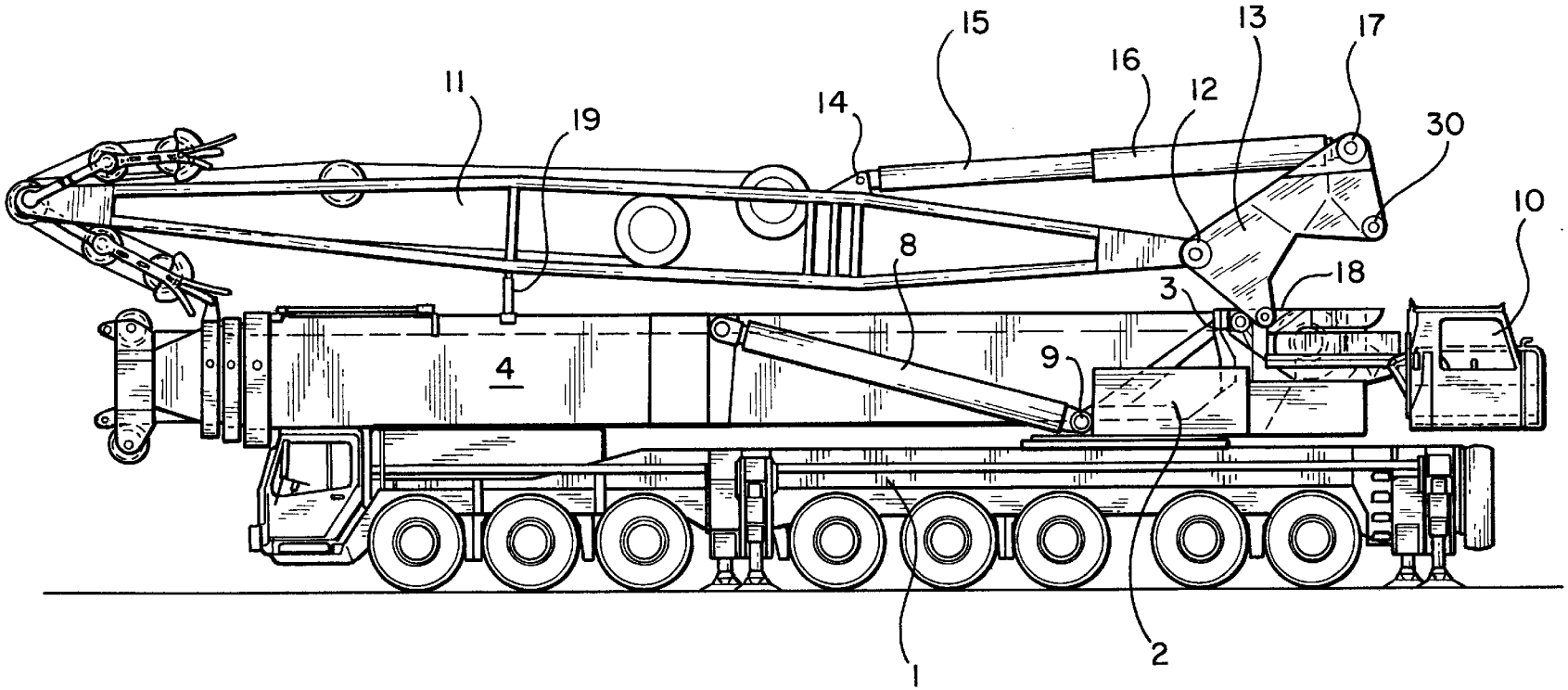

From FIG. 1 a crane vehicle with extended outriggers can be seen on whose vehicle chassis 1 a rotating deck 2 is supported which can be rotated in a conventional manner by a slewing ring connecting it to the vehicle chassis. On the rotating deck, the fulcrum part 4 of the telescoping jib is pivoted around a horizontal axis of rotation 3 with the telescoping sections 5, 6, 7 being able to be telescoped out of the telescoping jib. On both sides of the fulcrum part 4 the piston rods of luffing rams 8 are fulcrumed which are hinge-connected with the rotating deck 2 around the aligned axles 9. A crane cabin 10 is connected to the rotating deck which crane cabin 10 can be swivelled out of the transport position shown from FIG. 1 into the position shown from FIG. 2 for crane operation. To this extent, the mobile crane is of a conventional construction so that any more detailed description can be omitted.

On the telescoping jib shown in FIG. 1, a counter-jib 11 has been placed using an auxiliary crane. The counter-jib 11 is then hinge-connected at point 12 to a supporting frame 13. The counter-jib 11 is hinge-connected at point 14 to the piston rod 15 of a hydraulic ram 16 which is fulcrumed to the supporting frame 13 at point 17.

The counter-jib of the supporting frame is placed on the telescoping jib 4 in such a way by the auxiliary crane that the supporting frame 13 can be bolted to boreholes of the rotating deck 2 at its inner point of fulcrum 18. The hinge-connection of the supporting frame 13 with the rotating deck 2 formed by the bolting is located in the manner visible from FIG. 1 in the area of the hinge-connection 3 of the telescoping jib with the rotating deck. In the front area, the counter-jib 11 is provided with an outrigger protector 19 over which it is supported in a sliding fashion on the fulcrum part 4 of the telescoping jib.

At its tip, the counter-jib 11 bears a first suspension clip 21 (FIG. 6) which can be swivelled around the axle 20, on which suspension clip 21 a set of small pulleys 22 is supported. On the clip 21 a bearing portion 23 for small pulleys of a block 24 is held whose suspension clip 25 is retained in the forked retaining portion. By a corresponding raising of the counter-jib 11 and a swivelling of the retaining portion 23, the suspension clip 25 of the block 24 is brought to a position where in the manner visible, for example, from FIGS. 5 and 6, it can be bolted to the outer collar 26 of the telescope section 6. Subsequently, the rotating deck is swivelled though 180° from the position visible from FIG. 1 to the position in FIG. 2. By extending the luffing ram 8, the retracted telescoping jib is then swivelled into the position visible from FIG. 3.

In the counter-jib 11 there are installed an adjustment winch 28 (FIG. 2) and a ballast winch 29 whose hydraulic motors are supplied with hydraulic oil from the hydraulic unit of the mobile crane once the corresponding hydraulic lines have been connected.

Figure 2:
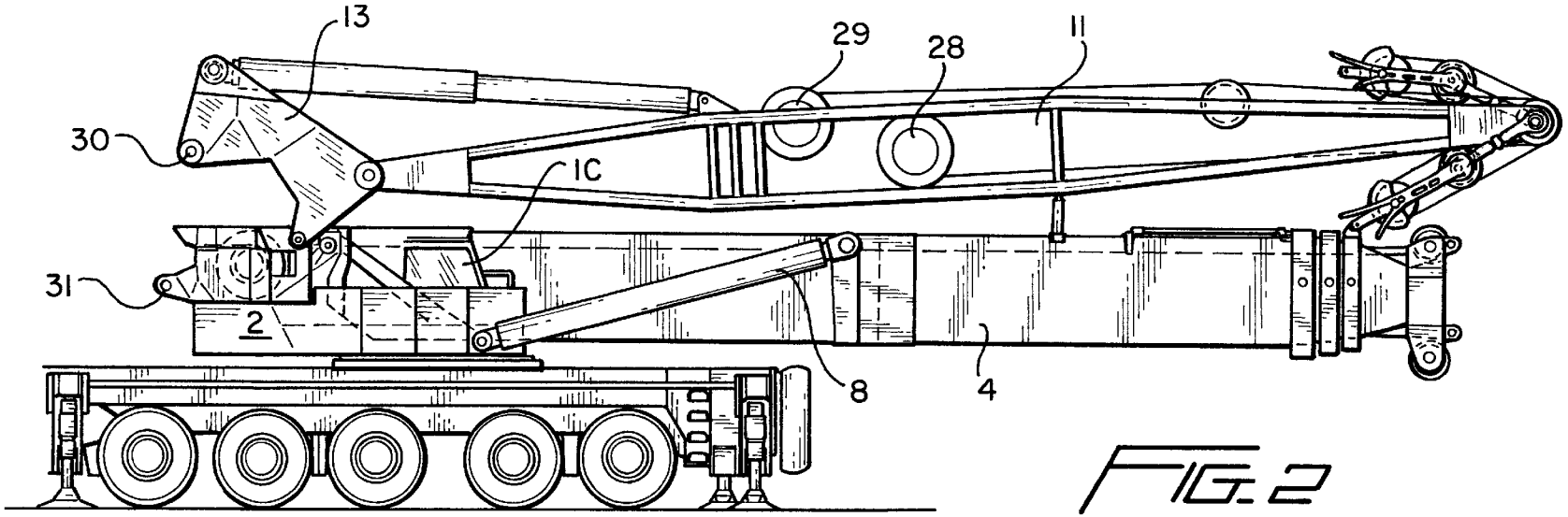
FIG. 2 a representation of the mobile crane of FIG. 1 after turning the rotating deck through 180°.
Figures 3, 9:
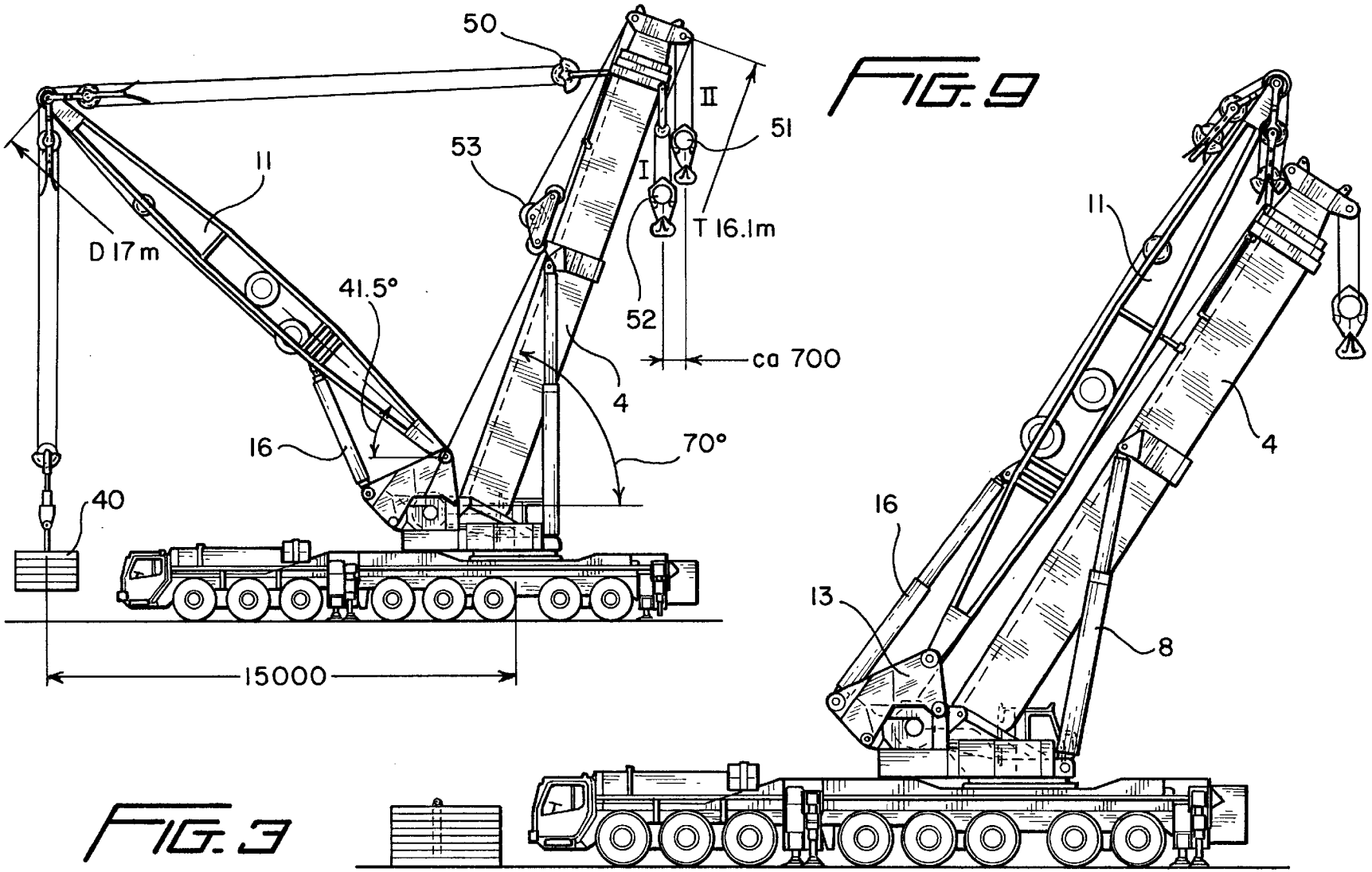
FIG. 3 a side view of the mobile crane of FIG. 2 where the telescoping jib has been luffed up so much that the supporting frame of the counter-jib can be bolted with its second connecting point to the rotating deck.
FIG. 9 a side view of the mobile crane converted to a very heavy load crane.

The fulcrum part with the retracted telescope sections is aligned from the position visible from FIG. 2 via the luffing rams 8 into the position visible from FIG. 3, with a second connect point 30 of the supporting frame 13 being swivelled about a first connect point in the direction of the outer connection boreholes 31 of the rotating deck 2 so that the corresponding boreholes can be bolted in their aligned positions. After the counter-jib 11 has been bolted to the rotating deck 2 by its supporting frame 13 in the manner described above, the counter-jib 11 is swivelled backwards by its ram 16, with the adjusting rope reeved via the rope blocks 22, 24 being unreeled after the release of the adjustment winch 28.

Figure 4:
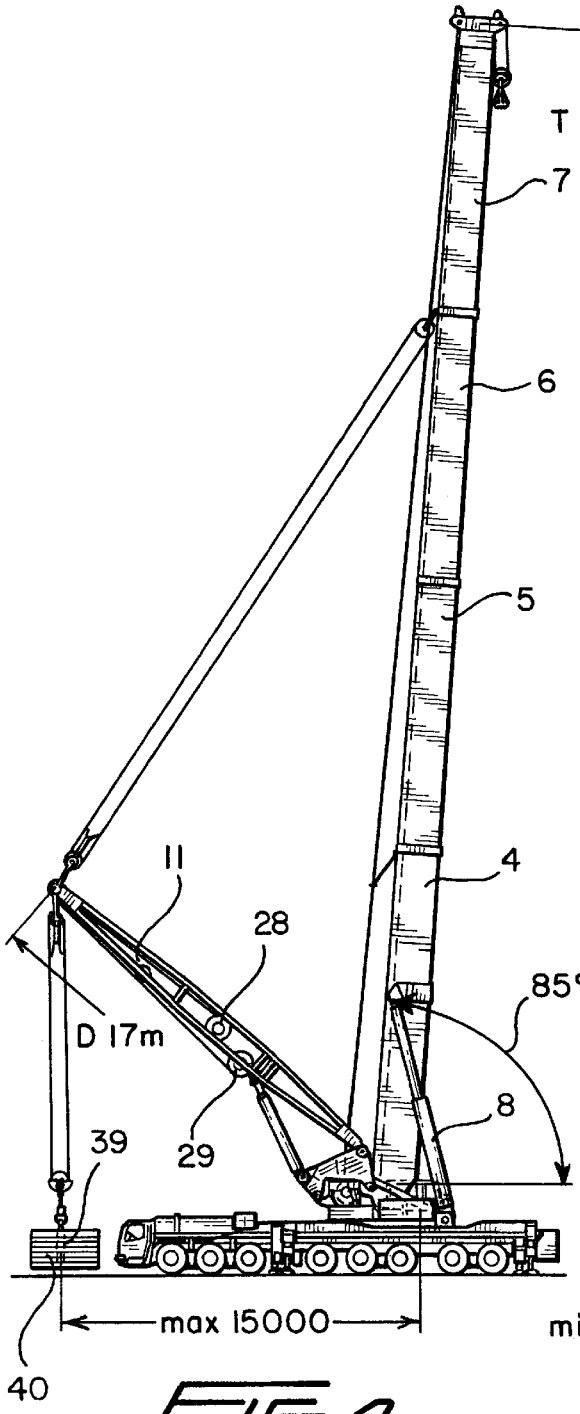
FIG. 4 the mobile crane of FIGS. 1 to 3 with luffed and extended telescoping jib and lowered counter-jib with ballast hung on it.
Figure 7:
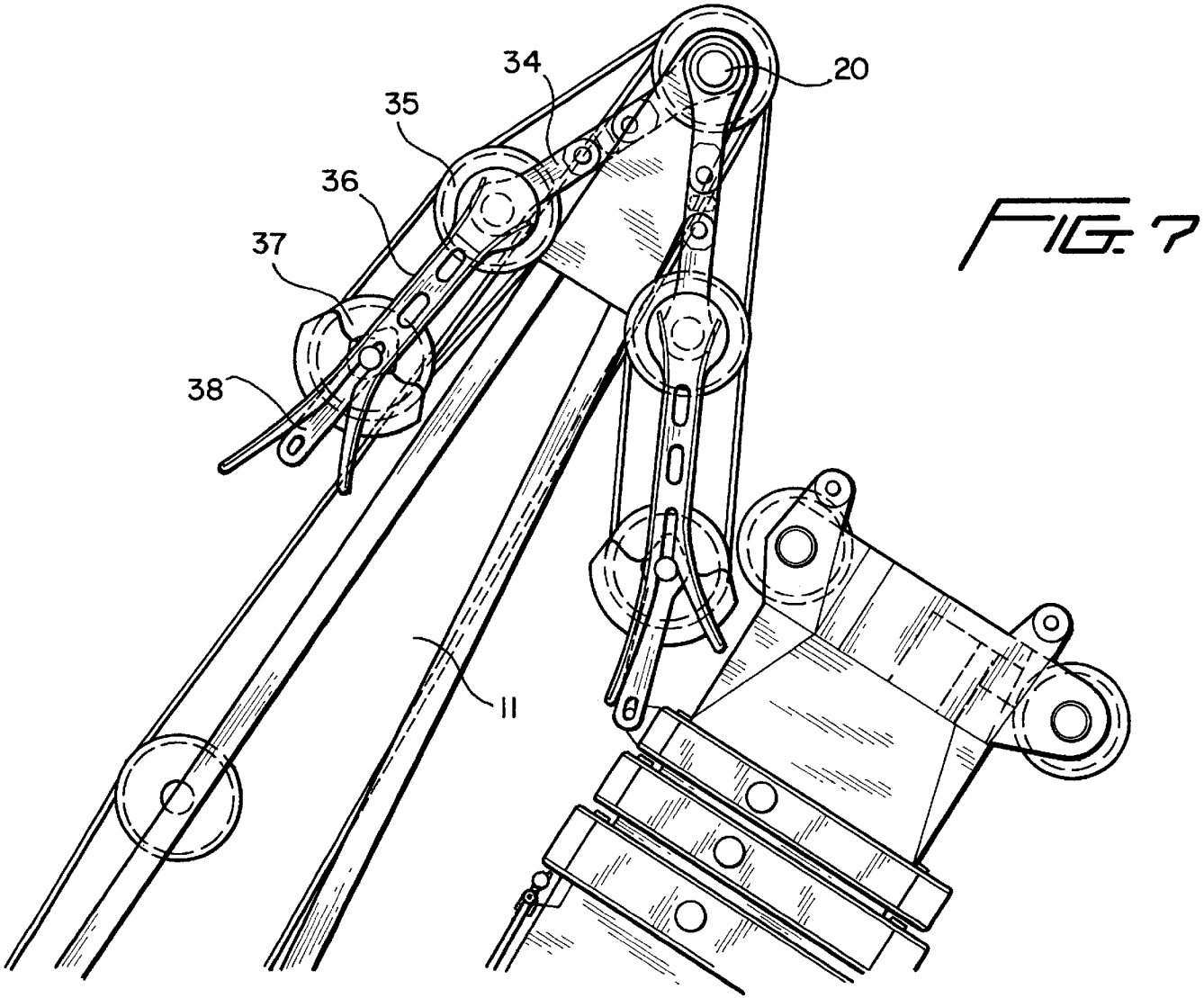
FIG. 7 a corresponding representation of the clip of the block of the adjusting rope bolted to the outside collar of the second telescoping section in the luffed state of the telescoping jib as visible from FIG. 3.

On the axle 20 at the tip of the counter-jib 11, there is further supported a suspension clip 34 (FIG. 7) on which a set of small pulleys 35 is supported. Furthermore, a bearing portion 36 is connected to the clip which bearing portion 36 serves to retain the small pulleys of the block 37 with suspension clip 38. A rack is coupled to the suspension clip 38 in a manner not shown which rack serves to retain the ballast plates. This rack 39 has such a large weight that it reels off the ballast rope from the ballast winch in the position of the counter jib visible from FIG. 4 so that the rack can be lowered to accept the ballast plates 40.

After extending the telescope sections 5, 6, 7, the mobile crane converted to a derrick crane is now in its operating position.

In crane operation (FIG. 4), the ram 16 holds the counter jib 11 in the position corresponding to the actual load status of the crane, from which position the telescoping jib can only be lowered and raised via the adjustment winch 29. In crane operation with counter-jib, the luffing rams 8 of the telescoping jib are switched to 'float' position so that they are disabled. The luffing rams 8 can, however, serve as safety retainers by restricting the largest luffing angle of the telescoping jib in such a way that any overturning of the telescope jib in the event of wind forces or loads breaking off is prevented.

Figure 5:
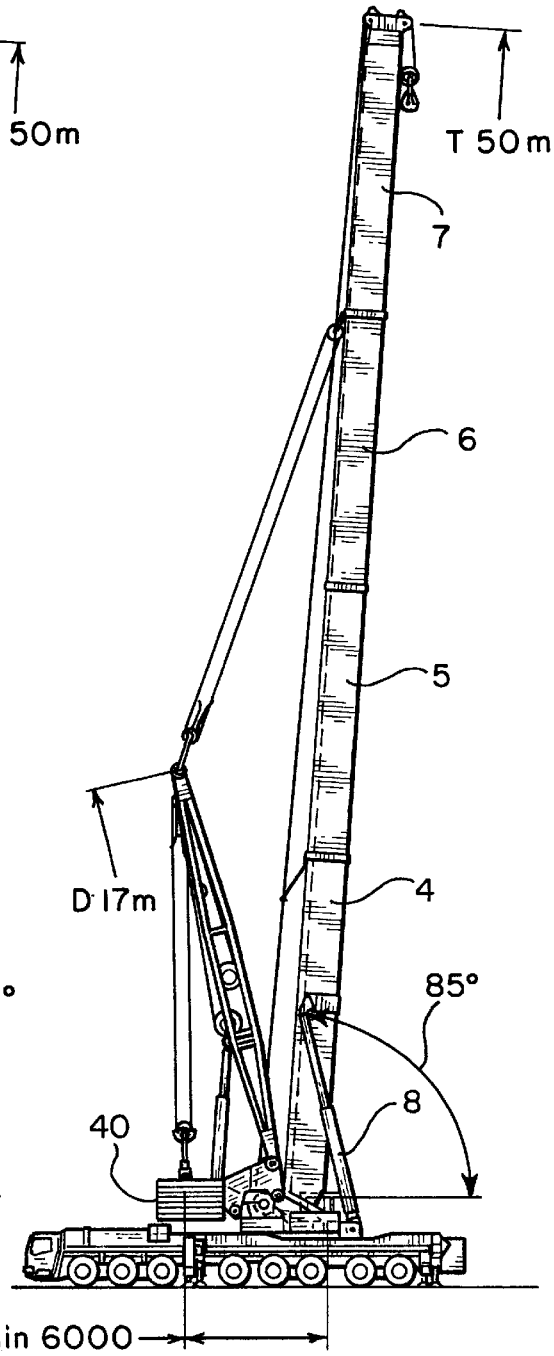
FIG. 5 a view of the mobile crane of FIG. 4 on which the counter-ballast has been swivelled closely to the rotating deck.
Figure 6:
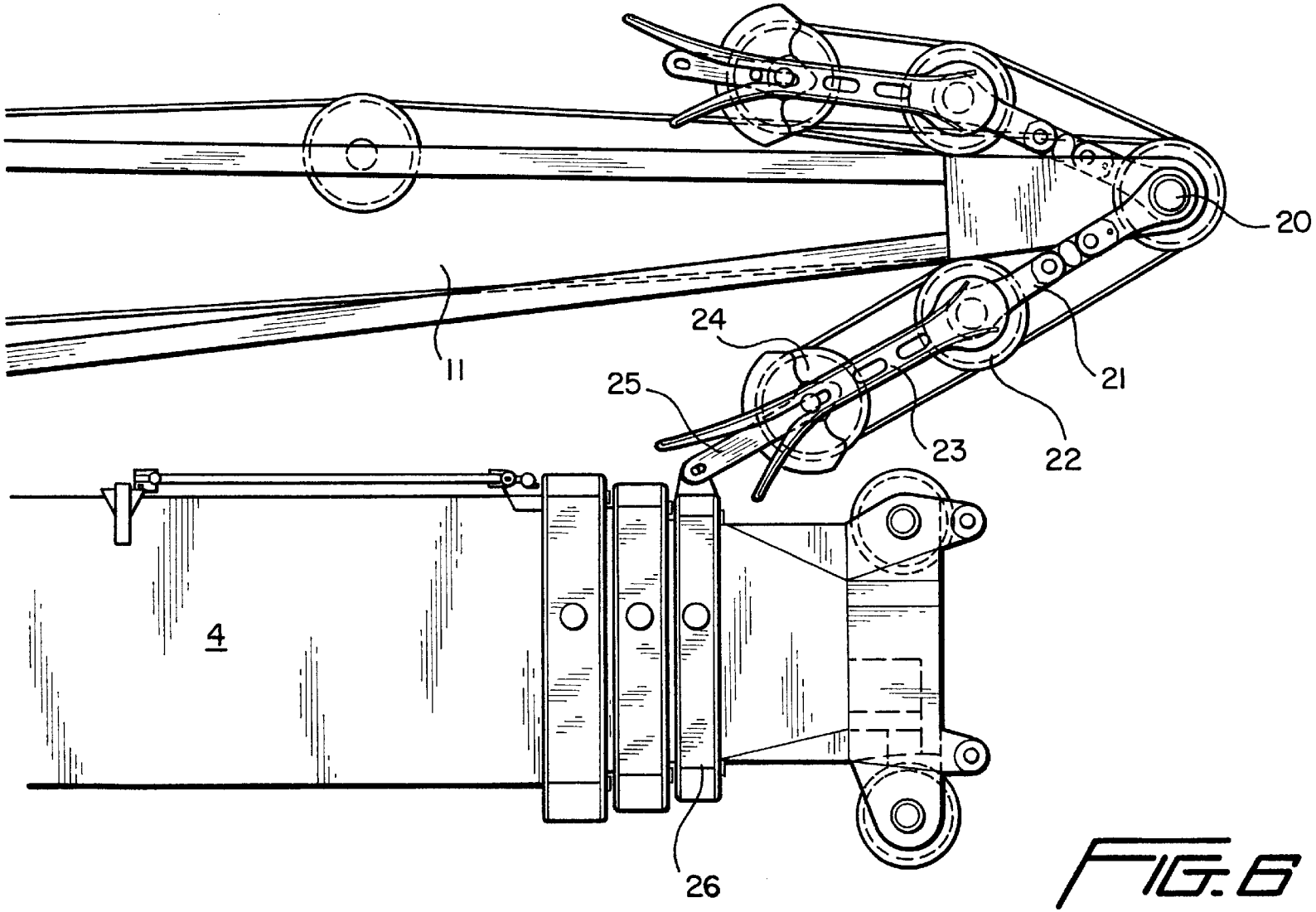
FIG. 6 an exploded representation of the clip of the block of the adjusting rope of FIG. 1 bolted to the outside collar of the second telescoping section.

In FIG. 5 the mobile crane is visible in a state where by luffing up the derrick jib, the rearward radius described by the tip of the counter-jib 11 is reduced to such an extent that the ballast 40 is located within the support base so that the crane can also be rotated without a load. This is a substantial advantage over known derrick cranes in which the ballast has to be reloaded by an auxiliary crane for a new load case.

Figure 8:
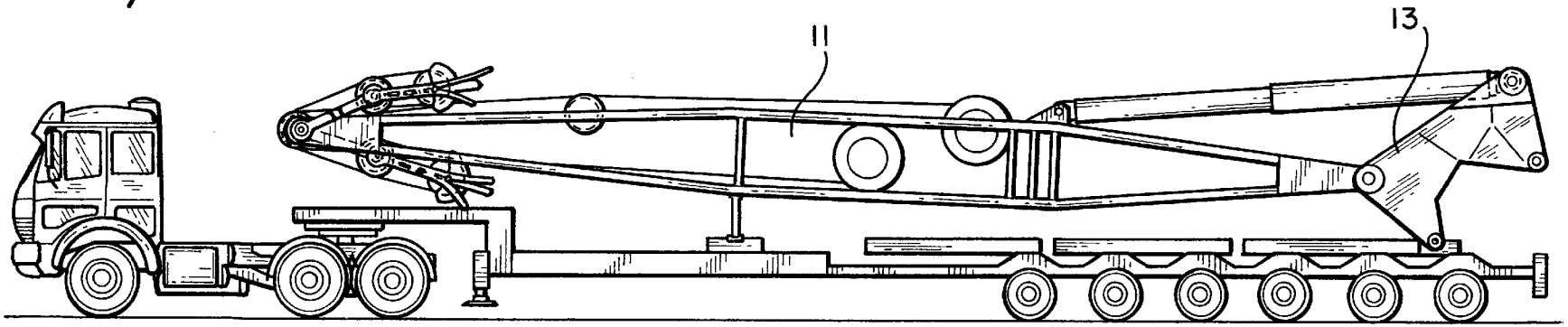
FIG. 8 a side view of the counter-jib loaded on a low-bed trailer.

In FIG. 8 the transport of the counter-jib on a special truck tractor for semi-trailers is visible. If the mobile crane in accordance with the invention needs to be operated as a derrick crane, the separately transported counter-jib 11 is placed on the telescoping jib by means of an auxiliary crane.

In FIG. 9 a side view of the crane in accordance with the invention is visible which is converted to a heavy duty crane with high lifting capacity. An additional block 50 is bolted to the collar of the jib fulcrum part 4 or the first telescoping section. In addition to the hook-type bottom block 51, which is hung on the upper end of the inner telescope section, a further hook-type bottom block 52 is provided which is hung on the collar of the fulcrum part 4 or the first telescoping section. To actuate this hook-type bottom block, a special winch 53 is provided which is mounted on the back of the fulcrum section 4.

Naturally, it is also possible to provide the crane in accordance with the invention converted to a derrick crane with additional and possibly luffable needle-type jibs mounted on the tip of the telescoping jib.

What is claimed is:

1. A mobile crane comprising:

a rotating deck;

a jib supported by said deck and pivotally connected thereto;

a first hydraulic ram connected to the jib for rotating the jib with respect to said deck about its pivotal connection with said deck between a lowered transport position and a raised position;

a counter-jib supporting a ballast, said counter-jib supported on said jib in said lowered transport position and movable with said jib between the lowered transport position and the raised position of the jib;

a support frame connected to said deck at a first connect point adjacent said pivotal connection between said jib and said deck and connected to said deck at a second connect point when said jib is in the raised position and disconnected from said deck when said jib is in the lowered transport position, and wherein said support frame is rotatably connected to said counter-jib;

a second hydraulic ram connected to said counter-jib and to said support frame, said second hydraulic ram rotating said counter-jib with respect to the support frame about the rotatable connection of said counter-jib and support frame when the support frame is connected to said deck at said second connect point; and wherein rotation of the jib, and the counter-jib supported thereon, by the first hydraulic ram from said lowered transport position to the raised position rotates the support frame about the first connect point with respect to the deck to the second connect point for connection of the support plate to said deck at said second connect point.

2. A mobile crane in accordance with claim 1, wherein an adjustment winch and a ballast winch are installed in the counter-jib.

3. A mobile crane in accordance with claim 1 & 2, wherein the jib can be luffed up by an adjusting rope.

4. A mobile crane in accordance with claim 1, further comprising a ballast rope reeved over a block held at the counter-jib tip.

5. A mobile crane in accordance with claim 1–4, wherein said the ballast rope can be unreeled by the weight of a rack.

6. A mobile crane in accordance with claim 1, further comprising a suspension clip connected to a rack holding the ballast.

7. The mobile crane of claim 1, wherein said deck and the second connect point of said support frame each have respective boreholes that come into alignment when the jib is raised into the raised position, and further comprising a bolt passing through the respective aligned boreholes to connect said support frame to said deck at the second connect point.

8. The support frame of claim 1, wherein the counter-jib can be easily removed from the crane and replaced.

9. The crane of claim 1, wherein the second connect point deck is substantially displaced in a horizontal position from the first connect point.

10. The crane of claim 1, wherein a position at which the support frame is connected to the counter-jib is aligned vertically with said deck when the jib is raised to the raised position.

* * * * *